US007609995B2

(12) United States Patent
Cruz

(10) Patent No.: US 7,609,995 B2
(45) Date of Patent: Oct. 27, 2009

(54) DEVICE FOR HELPING TONER CARTRIDGE RECHARGING FOR PRINTERS

(76) Inventor: Luciano Piquet da Cruz, Av. Argemiro de Figueiredo, 1010, João Pessoa (BR)

( * ) Notice: Subject to any disclaimer, the term of this patent is extended or adjusted under 35 U.S.C. 154(b) by 239 days.

(21) Appl. No.: 11/759,514

(22) Filed: Jun. 7, 2007

(65) Prior Publication Data

US 2007/0286637 A1 Dec. 13, 2007

(30) Foreign Application Priority Data

Jun. 8, 2006 (BR) ..... 0602541

(51) Int. Cl.
*G03G 15/00* (2006.01)

(52) U.S. Cl. ..... 399/109; 399/111; 399/261

(58) Field of Classification Search ..... 399/107, 399/109, 110, 222, 238, 252, 261, 262
See application file for complete search history.

(56) References Cited

U.S. PATENT DOCUMENTS 7,283,772 B2 * 10/2007 Amano et al. ..... 399/258

* cited by examiner

*Primary Examiner*—Hoan H Tran
(74) *Attorney, Agent, or Firm*—Volpe And Koenig, P.C.

(57) ABSTRACT

Device for helping toner cartridge recharging for printers is presented. The device includes a supporting cable, perpendicularly engaged to a supporting structure having in one of its ends a vibration head, having inside and being stuck by a clamp a motor in which axis there is a nylon circular part that has an eccentric pin. The structure includes on the other end a part having a universal nozzle, the supporting cable internally running the energy wire that connects to a converter.

3 Claims, 2 Drawing Sheets

DEVICE FOR HELPING TONER CARTRIDGE RECHARGING FOR PRINTERS

FIELD OF THE INVENTION

The present invention refers to a device for homogenizing, releasing and displacing toner powder from inside and from walls of its containers to the interior of cartridges for laser printers through vibrating movements.

BACKGROUND

In general, toner powder is stored in plastic containers and because they are formed by very thin particles they get condensed very fast adhering to such containers walls. Humidity and electric charges presented in powder also affect its fluidity when poured. In general, such containers have outpour nozzles called universal nozzles once they measure is always the same, changing just the plastic container dimensions that hold the toner.

The powder is generally poured from plastic container having the universal nozzle on the toner cartridge to be recharged through transversal vibration movements following cartridge master cylinder.

By trying to pour the powder from its container due to condensation, it is necessary to shake it or to press it, being also necessary at times to hit the container external walls in order for the powder to unstuck what causes pouring of a volume of powder higher or lower than the desired, thus never achieving a constant and homogeneous process of powder outpouring.

In order to avoid such condensation, there are several devices that permit powder outpouring in a controlled way over the toner. Such devices are generally built by fix bedplates having in its superior part a toner reservoir which is manually or automatically activated.

This solution, besides occupying a huge space is expensive not acquirable for small companies.

It is objective of this invention allowing the user to be able to pour the toner in a controlled and uniform way on the cartridge without using devices that are expensive and occupy wide space.

This objective is achieved by means of a device that is suitable for interacting with called universal nozzles and that by means of vibration releases the powder contained inside the container allowing it to flow in more a constant and uniform way from the universal nozzle to inside the cartridge.

BRIEF DESCRIPTION OF THE DRAWINGS

For a better understanding of the present invention there are figures attached that in a schematic way, but not limited to, describe.

DETAILED DESCRIPTION OF THE PREFERRED EMBODIMENTS

Figure 1:
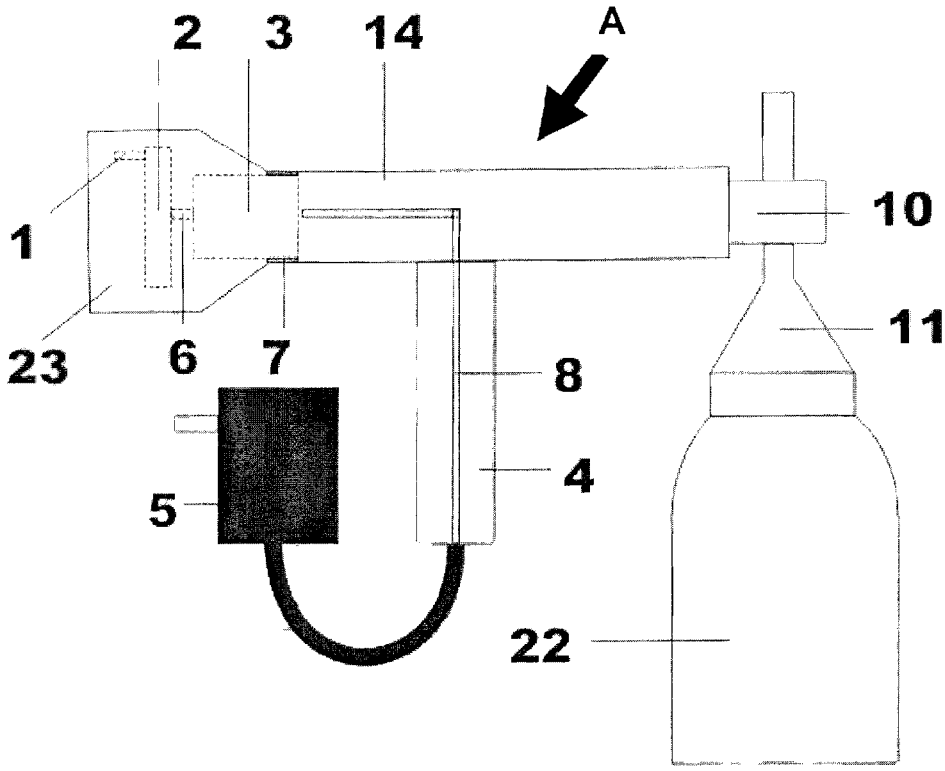
FIG. 1—cut side view of the device.
Figure 2:
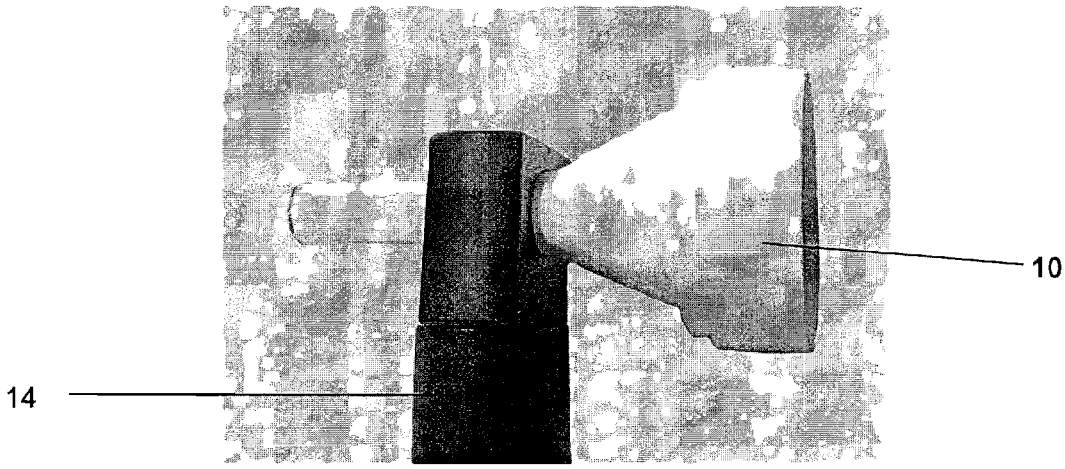
FIG. 2—side view in details of the device fitting in the universal nozzle.
Figure 3:
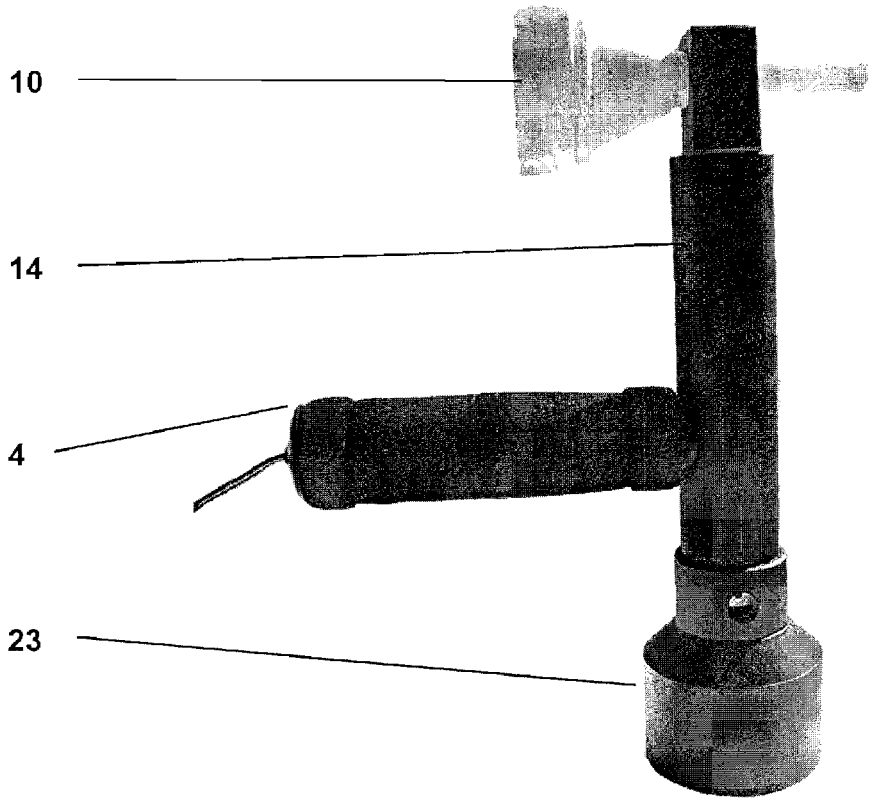
FIG. 3—perspective view of the device.
Figure 4:
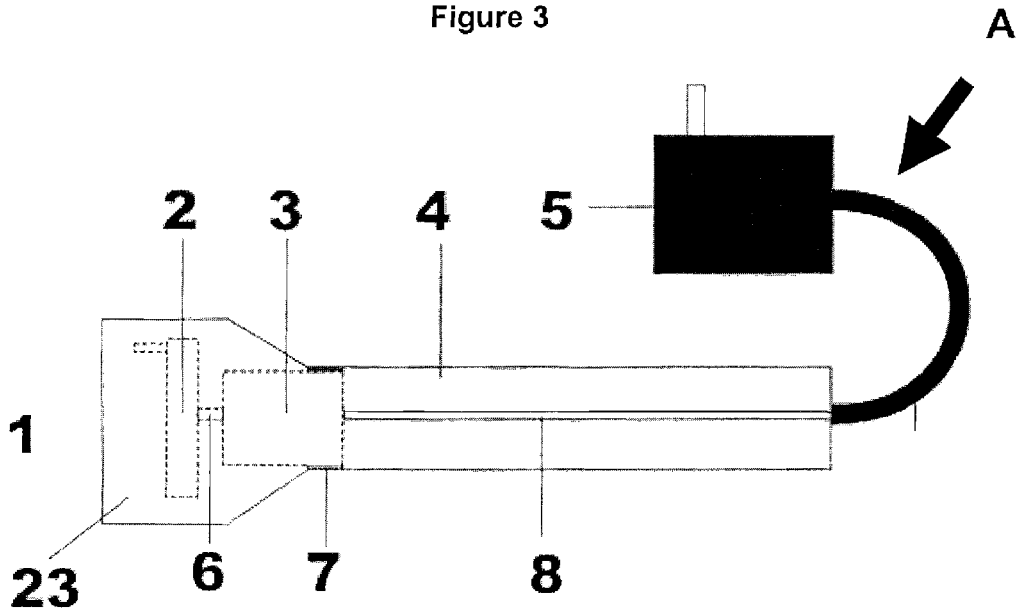
FIG. 4—cut side view of a simplified variant of the invention device.

Device A, object of the present invention, consists of a supporting cable (4), supporting structure (14) and a vibration head (23), this set forms a T structure. Inside cable (4) runs the energy wire (8) that leaves the cable (4) and connects to a converter (5).

Inside the vibration head (23) there is a motor (3), engaged by a clamp (7), in which axis (6) there is a circular nylon part (2) having an eccentric pin (1) that, with motor spin (3) makes the device A to vibe at a preset frequency. This frequency varies between 30 and 85 Hertz, and under and above this layer there is a sub-vibration and over-vibration respectively, such vibrations that cause discomfort to user.

On the opposed edge of the supporting structure (14) there is a nylon carved part (10) in which a universal nozzle (11) that receives all types of containers of storage (22) of toner powder is attached.

The simplified version B of the device now proposed has a supporting cable (4) and a vibration head (23). Inside the cable (4) runs the energy wire (8) that leaves cable (4) and connects to a converter (5). Inside the head of vibration (23) there is a motor (3), stuck by a clamp (7), in which axis (6) there is a nylon circular part (2) that has an eccentric pin (1) that with motor spin makes the device B vibrate.

The complete version of device A has as main objective to vibrate the universal nozzle (11) when it is put upside-down in order to fill in the cartridge with toner descendant from plastic container. In this position the device vibration makes the toner to easily flow maintaining a constant and uniform flow.

The simplified version of device B may be pressed over toner cartridge making the powder to accommodate in the cartridge in a uniform way.

The effect of vibration can optionally also be provided by means of parts in other materials, having different balancing or even vibrations by means of oscillation of magnetic pendulum or other.

The device of the present invention has as main advantage the fact of being portable, allowing its transport and usage by any user, being low cost and allowing a uniform distribution of toner powder on the cartridge.

The invention claimed is:

1. Device for helping toner cartridge recharging for printers characterized for comprising a supporting cable (4), perpendicularly engaged to a supporting structure (14) having in one of its ends a vibration head (23), having inside and being stuck by a clamp (7), a motor (3) in which axis (6) there is a nylon circular part (2) that has an eccentric pin (1), said supporting structure (14) having on the other end a part (10) having an universal nozzle (11), the supporting cable (4) internally running the energy wire (8) that connects to a converter (5).

2. Device, according to claim 1, wherein the vibration head vibrates at a frequency between 30 and 85 Hertz.

3. Device, according to claim 1, characterized by the fact said supporting structure (14) is optionally incorporated to supporting cable (4).

* * * * *